US005363616A

United States Patent [19]

Hernandez

[11] Patent Number: 5,363,616

[45] Date of Patent: Nov. 15, 1994

[54] ADJUSTABLE CORNER MULLION FOR JOINING BUILDING PANELS

[75] Inventor: Ana M. Hernandez, Miami, Fla.

[73] Assignee: Diston Industries, Inc., Hialeah, Fla.

[21] Appl. No.: 928,715

[22] Filed: Aug. 13, 1992

[51] Int. Cl.[5] ..... F04B 1/343

[52] U.S. Cl. ..... 52/281; 52/71; 52/282.2; 52/239; 160/199; 160/135; 16/355

[58] Field of Search ..... 52/238.1, 239, 281, 52/282.1, 282.2, 588.1, 582.2, 71, 595, 285.1; 160/135, 199, 206, 235; 403/4, 387, 331, 364; 16/269, 355

[56] References Cited

U.S. PATENT DOCUMENTS

| | | | |
|---|---|---|---|
| 3,359,594 | 12/1967 | Pastoor | 160/199 |
| 3,373,791 | 3/1968 | Milani | 160/199 |
| 3,546,845 | 12/1970 | Kempel | 160/235 X |
| 3,585,768 | 6/1971 | Klein | 52/238.1 |
| 4,104,839 | 8/1978 | Balzer et al. | 52/281 X |
| 4,785,565 | 11/1988 | Kuffner | 160/135 |
| 4,968,171 | 11/1990 | Shell | 52/282.1 X |
| 5,097,883 | 3/1992 | Robinson et al. | 160/199 |

*Primary Examiner*—Carl D. Friedman
*Assistant Examiner*—Winnie Yip
*Attorney, Agent, or Firm*—Shook, Hardy & Bacon

[57] ABSTRACT

An adjustable mullion is provided for forming a corner or joint between two building panels such as in the formation of shower enclosures, walls, partitions and the like. The mullion can be adjusted through an arc of up to 90 degrees in one orientation and can be inverted to provide a total of 180 degrees of movement. The mullion comprises two members which can be cooperatively interconnected before or after joinder to the panels. Each member includes an elongated barrel portion which is generally arcuate in cross-section. One of the barrels is sized for being received and retained within the other barrel to form an adjustable joint between the mullions.

15 Claims, 1 Drawing Sheet

Fig. 1.
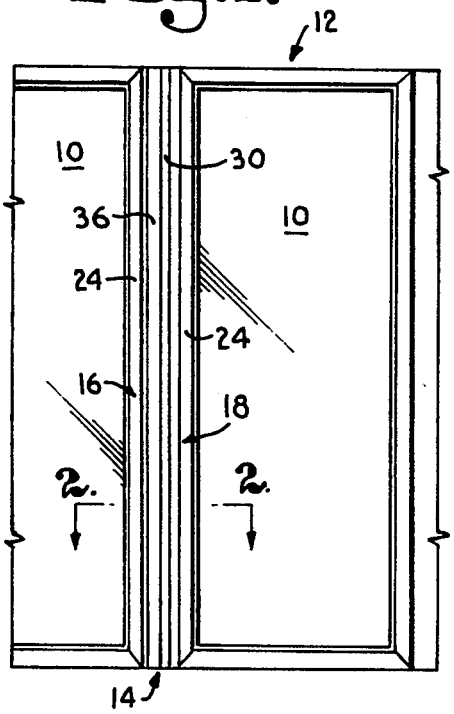
Fig. 2.
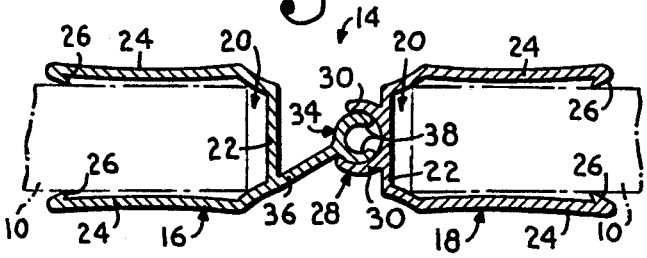
Fig. 3.
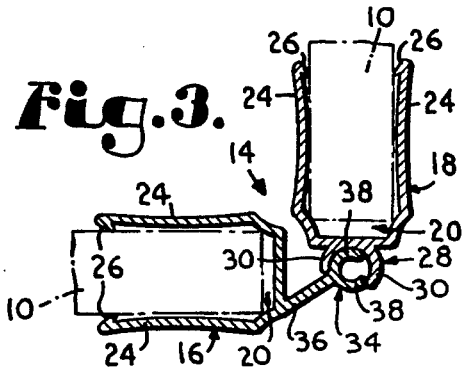
Fig. 4.
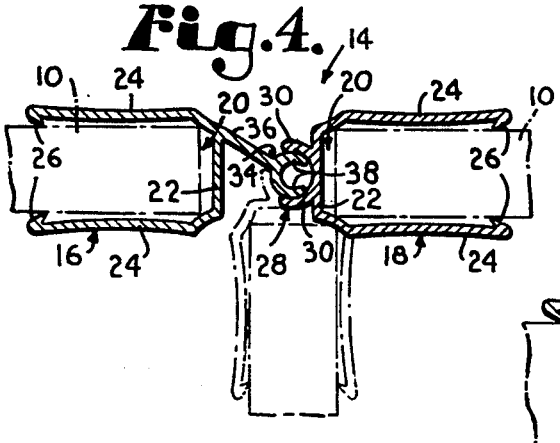
Fig. 7.
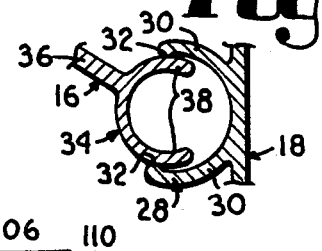
Fig. 6.
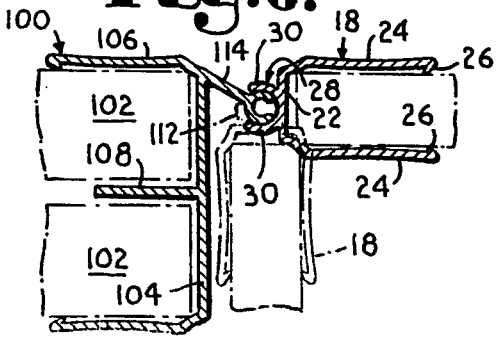
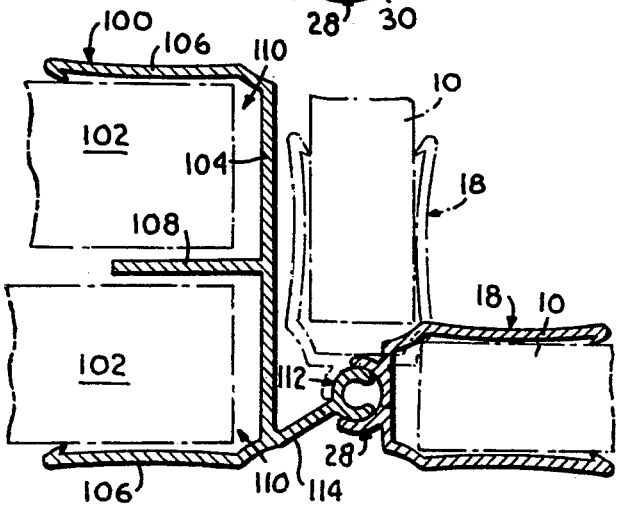
Fig. 5.

ADJUSTABLE CORNER MULLION FOR JOINING BUILDING PANELS

BACKGROUND OF THE INVENTION

This invention relates in general to construction materials, and, more particularly, to a construction member known as a corner mullion which is useful for joining building panels such as shower walls.

Corner joints or "mullions" are frequently used to join together building panels such as shower stall panels or wall panels and to provide a finished appearance to the joint between the panels. These corner mullions can be quickly attached to the panels to form the joint and substantially reduce the amount of time required for the builder to complete the structure being formed from the panels.

Conventional mullions are most typically used to form a ninety degree corner but a builder will often have a need for a mullion which can be used to form other angles that are commonly encountered during construction. However, a builder, particularly a subcontractor, may not be aware of the type of corner mullion that will be required until he is actually at the job site. The subcontractor is then forced to carry with him a variety of mullions suitable for forming the corner angles most likely to be encountered or else considerable delays will be encountered in ordering and obtaining the appropriate mullions. In addition, a need often arises for a mullion suitable for forming odd angles because the panels being joined have been improperly aligned or the structure being formed has an unusual geometric design. Thus, even if the subcontractor maintains a large supply of different mullions, he is frequently likely to lack the right mullion needed for a particular job. The subcontractor must then obtain or fashion the appropriate mullion or use other techniques to finish the corner or joint. In either event, completion of the project is delayed considerably by the lack of an appropriate mullion.

SUMMARY OF THE INVENTION

It is an object of this invention to provide a corner mullion which is adjustable so that it can be used to join building panels at a wide range of angles.

It is also an object of this invention to provide a corner mullion which can be used to join building panels at different angles so that a suitable mullion is always available to finish even the odd angled corners without the need to stock a multitude of different mullions.

It is another object of this invention to provide a corner mullion which can be adjusted through an arc of up to 180 degrees to accommodate placement of building panels at a wide range of angles so that greater design flexibility is available when using building panels to form structures such as shower stalls and walls.

To accomplish these and other related objects, the invention is directed to a mullion for forming a joint between first and second panels, said mullion comprising:

- a first member having a channel formed for receiving said first panel;
- a second member having a channel formed for receiving said second panel; and
- means on said first and second members for interconnecting said first and second members to form said joint and to allow variable angular positioning of said first and second members.

The means for interconnecting the first and second members preferably comprises an incomplete or open circular wall on each of said second members. The walls are positioned and sized so that one wall may be releasably received and retained within the other wall. When interconnected, the walls are free to rotate about an axis of rotation to allow the panels to be secured at various angular positions along an arc which may be up to 180 degrees. Notably, the mullion does not support the panels and thus functions as an adjustable joint rather than a hinge.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a fragmentary side elevational view of a pair of building panels which are joined together using a corner mullion in accordance with the present invention;

FIG. 2 is a top plan view of the corner mullion and a portion of the building panels taken in horizontal section along line 2—2 in FIG. 1 in the direction of the arrows and shown on an enlarged scale, the building panels being shown in fragmental lines;

FIG. 3 is a top plan view of the corner mullion similar to the view shown in FIG. 2 but with the mullion being adjusted to place the panels at a 90 degree angle rather than the 180 degree angle shown in FIG. 2;

FIG. 4 is a top plan view of the corner mullion and the building panels, the building panels being shown in fragmentary lines and one of the members of the corner mullion being inverted from the orientation shown in FIGS. 2 and 3 to allow placement of the building panels at 90 degrees in the opposite direction from that shown in FIG. 3, as illustrated by the broken lines;

FIG. 5 is a top plan view of an alternate embodiment of a corner mullion in accordance with the present invention, the building panels being shown in broken lines and fragmental lines being used to illustrate an alternate position for the mullion;

FIG. 6 is a top plan view of the mullion and building panels shown in FIG. 5 but on a slightly reduced scale and with one of the members of the corner mullion being inverted and broken lines showing placement of the mullion at a 90 degree angle in the direction opposite that shown in fragmental lines in FIG. 5; and FIG. 7 is a fragmentary top plan view of the interlocking portions of the mullion shown on an enlarged scale to show further details of their construction.

DESCRIPTION OF THE PREFERRED EMBODIMENT

Referring now to the drawings in greater detail, and initially to FIG. 1, a pair of building panels 10 are shown joined together in accordance with the present invention to form a structure 12. Panels 10 may be formed of any of various materials suitable for use for construction purposes. As an example, panels 10 may be formed of glass, polymeric material, sheetrock, metal, wood or other building materials. Structure 12 which is formed from panels 10 may be a shower enclosure, closet, wall, partition or other building portion.

The panels 10 are joined together by an adjustable mullion 14 which is shown in greater detail in FIGS.

2–4. Mullion 14 comprises two interlocking members 16 and 18 which can be rotated about a pivot axis to provide the angle desired for positioning of the panels 10. The mullion members 16 and 18 may be formed of various suitable materials, including decorative metals, which are suitable for the intended finish to be provided to or by the mullion 14. For example, if mullion 14 is to remain exposed after the structure 12 has been completed, then the material chosen for mullion 14 may include various plated metals.

Each member 16 and 18 includes a U-shaped channel 20 in which the associated panel 10 is inserted and maintained, such as by an adhesive, screws or other suitable means. The channels 20 are defined by a base 22 and flanges 24 which are joined to the base 22 and are spaced apart in an amount corresponding to the thickness of the panels 10. When screws are used to retain the panels 10 within the channels 20, suitable screw holes (not shown) may be provided in one or both of the associated flanges 24. A retaining lip 26 is provided on the inner face of each flange 24 at the free end thereof to provide a shoulder against which a sealing caulk or other material may be applied to provide a seal between the panel 10 and flanges 24.

An interlocking adjustment barrel 28 is mounted to base 22 of member 18 opposite from the channel 20 defined by the base and flanges 24 Barrel 28 extends along the entire longitudinal length of member 18 and comprises facing arcuate walls 30 which form an incomplete or open circular wall in cross-section. Preferably, one of walls 30 is slightly longer than the other wall 30 so that a line connecting the free ends of the walls 30 extends at an angle to the base 22. As can best be seen in FIG. 7, a slight ridge 32 is formed on the inner face of the free end of each arcuate wall 30.

The barrel 28 on member 18 functions as a female receptacle and is sized to receive and releasably retain a similarly constructed male barrel 34 which is joined to the base 22 of the other member 16 by an extension 36. Male barrel 34 likewise extends along the entire length of associated member 16 and includes facing arcuate walls 38 which form an incomplete circle. The outer diameter of male barrel 34 is slightly less than the inner diameter of female barrel 28 so that it may be inserted within and releasably interlock with the female barrel 28. Male barrel 34 is free to rotate within the receiving female barrel 28 so that mullion members 16 and 18 may be placed in the desired orientation with respect to each other.

Because the barrels 28 and 34 form incomplete circles in cross-section, male barrel 34 may be inserted within female barrel 28 by simply placing the members 16 and 18 at an angle of ninety degrees as shown in FIG. 3 so that one of the walls 38 on male barrel 34 is completely inserted within the opening between walls 30 on barrel 28. Clockwise rotation of member 18 as viewed in FIG. 3 with then cause both walls 38 of male barrel 34 to be received between the walls 30 of female barrel 28. In order to retain male barrel 34 within female barrel 28, the inner distance between the free ends of female barrel walls 30 must be less than the outer diameter of male barrel 34. The ridges 32 formed on walls 30 are important in this regard as they decrease the distance across the free ends of barrel walls 30 to prevent removal of male barrel 34 but still permit the male barrel 34 to be loosely held within female barrel 28 to permit relative rotation of the barrels without binding.

In order to permit the insertion of male barrel 34 within female barrel 28 as described above, it is important that the extension 36 connected to male barrel 34 be offset from the center line of the male barrel 34 so that the associated barrel walls 38 are of unequal length. This provides the necessary clearance to allow the female barrel 28 to be inserted onto the male barrel 34 across an area of reduced diameter provided by the opening in barrel 34. Notably, the ability to interlock the barrels 28 and 34 in this fashion allows the mullion members 16 and 18 to be connected to their respective panels 10 before the barrels 28 and 34 are interlocked to provide the desired joint between the panels. It should also be understood that the barrels can alternately be joined together by placing the members 16 and 18 end-to-end and then sliding them length-wise to interlock the barrels 28 and 34.

In use, the mullion 14 can be used to quickly and easily form a corner or joint between the panels 10 which are secured to the mullion members 16 and 18. Desirably, the panels 10 can first be secured within the channel 20 formed by the members 16 and 18 and then the barrels 28 and 34 can be interlocked to join the panels together. It will also be appreciated that the barrels 28 and 34 could first be interlocked followed by securement of the mullion members 16 and 18 to the respective panels 10.

The mullion 14 can be adjusted to place the panels 10 at the desired angle required for building structure 12. As illustrated in FIG. 2, the panels 10 may be placed in alignment such that an angle of 180 degrees is formed. If desired, the panels 10 can be moved in one direction through an arc of up to 90 degrees to allow placement at various other angles including a right angle as shown in FIG. 3. One or both mullion members 16 and 18 can also be inverted to allow movement of the panels 10 in the opposite direction through an arc of up to 90 degrees, thereby allowing the panels to be placed in various fixed positions along a total arc of 180 degrees, as shown in FIG. 4. It should be understood that mullion 14 is adjustable to allow the panels 10 to be placed in the desired fixed position and is not intended to function as a hinge to allow swinging movement of the panels. Because the interlocking barrels 28 and 34 on the mullion members 18 and 16, respectively, extend the entire length of the members and the panels, the mullion 14 does not support the panels 10 but simply allows for their joinder at the desired angle.

It can be appreciated that mullion 14 allows for much greater design flexibility by allowing the structure 12 to be constructed by placing the panels 10 at any of various desired angles. Yet, because mullion 14 can be quickly and easily adjusted to accommodate those various angles, the builder can readily join the panels 10 without having to maintain a large supply of conventional mullions which are fixed at various angles or specially fabricating a mullion at the angle required. Substantial time and cost savings can thus be achieved using adjustable mullion 14.

Turning now to FIG. 5–6, it can be seen that mullion member 16 can be replaced with a double channeled member 100 of the type which can be used to accommodate by-pass doors 102 such as sliding shower doors. Mullion member 100 includes a base 104 and outer flanges 106 which are connected to the base 104. A divider 108 is also connected to the base 104 and is positioned midway between the outer flanges 106 to form side-by-side channels 110 having a width to accommodate doors 102. A male barrel 112 is also connected to an opposite side of base 104 by an extension 114. The male barrel 112 and extension 114 are constructed in a manner as previous described with respect to member 16.

The mullion member 100 is generally utilized in a fashion similar to member 16 to form a joint between the sliding doors 102 and the panel 10. It will be understood that one or both of doors 102 is preferably mounted in a fashion to allow sliding movement thereof.

From the foregoing, it will be seen that this invention is one well adapted to attain all the ends and objects hereinabove set forth together with other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A mullion for forming a joint between first and second panels, said mullion comprising:

a first member having a channel formed for receiving said first panel;

a second member having a channel formed for receiving said second panel;

a first barrel connected to said first member and a second barrel connected to said second member, said first and second barrels being constructed to allow said first barrel to be releasably received within said second barrel for interconnecting said first and second members in one orientation to form said joint and to allow variable angular positioning of said first member in relation to said second member along a first arc of movement, said first and second barrels being constructed to allow said first member to be inverted from said one orientation and then interconnected with said second member by releasably receiving said first barrel within said second barrel to reform said joint and allow variable angular positioning of said first member in relation to said second member along a second arc of movement which in substantial part extends beyond the first arc of movement and in opposite direction, said first and second arcs of movement together providing an approximately 180° range of movement between the first and second members.

2. The mullion as set forth in claim 1, wherein said first and second barrels each includes an arcuate wall forming an incomplete circle in cross-section, said arcuate wall of said first barrel having an outer diameter less than an inner diameter of the arcuate wall of said second barrel to permit said first barrel to be received within said second barrel.

3. The mullion as set forth in claim 2, wherein said first barrel is spaced from said channel of said first member by an extension which is connected to said arcuate wall at a position offset from a longitudinal center line of said first barrel.

4. The mullion as set forth in claim 3, wherein said extension extends obliquely to said first panel when said first panel is received within said first channel.

5. The mullion as set forth in claim 4, including a ridge positioned on an inner surface at each free end of the arcuate wall of said second barrel.

6. The mullion as set forth in claim 5, wherein said first and second barrels extend along substantially an entire longitudinal length of the first and second members.

7. The mullion as set forth in claim 6, including another channel in said first member positioned beside said first channel.

8. The mullion as set forth in claim 3, wherein said first arc of movement is approximately 90 degrees and said second arc of movement is approximately 90 degrees.

9. A mullion for forming a joint between first and second panels, said mullion comprising:

a first member having a channel formed for receiving said first panel;

a second member having a channel formed for receiving said second panel;

an incomplete circular first wall on said first member and an incomplete circular second wall on said second member, said first and second walls being sized and positioned for being interconnected in a first orientation with the first wall received within the second wall to form said joint and to allow variable angular positioning of said first member in relation to said second member along a first arc of movement of approximately 90°;

said incomplete circular first and second walls being constructed to allow said first member to be inverted from said first orientation and then interconnected with said second member with the first wall received within the second wall to reform said joint and allow variable angular positioning of said second member along a second arc of movement of approximately 90°, said second arc of movement extending in substantial part beyond the first arc of movement and in opposite direction, said first and second arcs of movement together providing an approximately 180° range of movement between the first and second members.

10. The mullion as set forth in claim 9, wherein said first wall has an outer diameter less than an inner diameter of the second wall to permit said first wall to be received within said second wall.

11. The mullion as set forth in claim 10, wherein said first wall is spaced from said channel of said first member by an extension which is connected to said first wall at a position offset from a longitudinal center line of said first wall.

12. The mullion as set forth in claim 11, wherein said extension extends obliquely to said first panel when said first panel is received within said first channel.

13. The mullion as set forth in claim 11, including a ridge positioned on an inner surface at each free end of the second wall.

14. The mullion as set forth in claim 13, wherein said first and second walls extend continuously along substantially an entire longitudinal length of the first and second members.

15. The mullion as set forth in claim 14, including another channel in said first member positioned beside side first channel.

* * * * *